US008592705B2

(12) United States Patent
Dai

(10) Patent No.: US 8,592,705 B2
(45) **Date of Patent: *Nov. 26, 2013**

(54) KEYPAD ASSEMBLY AND ELECTRONIC DEVICE USING THE SAME

(75) Inventor: Bin Dai, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 426 days.

This patent is subject to a terminal disclaimer.

(21) Appl. No.: 12/915,280

(22) Filed: Oct. 29, 2010

(65) Prior Publication Data

US 2012/0061222 A1 Mar. 15, 2012

(30) Foreign Application Priority Data

Sep. 10, 2010 (CN) ..... 2010 1 0278442

(51) Int. Cl.
*H01H 13/02* (2006.01)

(52) U.S. Cl.
USPC ..... 200/344; 200/343; 200/345

(58) Field of Classification Search
USPC ..... 200/5 A, 341–345; 345/168, 169; 400/490–496
See application file for complete search history.

(56) References Cited

U.S. PATENT DOCUMENTS

| | | | | |
|---|---|---|---|---|
| 5,376,765 | A * | 12/1994 | Holmes et al. | 200/344 |
| 5,901,837 | A * | 5/1999 | Aimi | 200/344 |
| 7,312,414 | B2 * | 12/2007 | Yatsu et al. | 200/344 |
| 2010/0089736 | A1 * | 4/2010 | Tsai et al. | 200/5 A |

* cited by examiner

*Primary Examiner* — Amy Cohen Johnson
*Assistant Examiner* — Marina Fishman
(74) *Attorney, Agent, or Firm* — Altis & Wispro Law Group, Inc.

(57) ABSTRACT

A keypad assembly includes a support member, a key switch, a keycap and a resilient member. The key switch is fixed on the support member, and includes a triggering portion. The keycap is located opposite to the triggering portion. The support member and the key switch are located between the keycap and the resilient member. The resilient member interconnects the keycap and the support member. The resilient member is elastically deformed via resisting the triggering portion when the key switch is not triggered.

17 Claims, 3 Drawing Sheets

KEYPAD ASSEMBLY AND ELECTRONIC DEVICE USING THE SAME

CROSS-REFERENCE TO RELATED APPLICATIONS

This application is related to four co-pending U.S. Patent Applications (application Ser. Nos. 12/913,006, 12/913,016, 12/915,277, 12/915,284), all entitled "KEYPAD ASSEMBLY AND ELECTRONIC DEVICE USING THE SAME", and the inventor is Bin Dai. Such applications have the same assignee as the instant application and are concurrently filed herewith. The disclosure of the above-identified applications is incorporated herein by reference.

BACKGROUND

1. Technical Field

The present disclosure relates to data input, and particularly, to a keypad assembly used in an electronic device.

2. Description of the Related Art

Electronic devices often provide a keypad on a panel thereof, thus allowing control input for a power source or other component by the user to be entered.

A keypad assembly is located on a housing of an electronic device. The housing defines a mounting port in a rear surface of the housing. The keypad assembly includes a keycap and a key switch. The keycap is received in the mounting port, and includes a protrusion arranged at a bottom of the keycap. The key switch includes a triggering portion and a contact point. The triggering portion is a convex resilient sheet the top of which the protrusion resists. When the keycap is depressed, the triggering portion is elastically deformed and electrically connected to the contact point. When the keycap is released, the triggering portion returns to its relaxed state. However, a clearance occurs between the protrusion and the triggering portion, due to manufacturing tolerance or assembly error. The keycap slides in the mounting port without any resistance because of the clearance, such that the contact response of the keypad assembly is lowered.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

Figure 1:
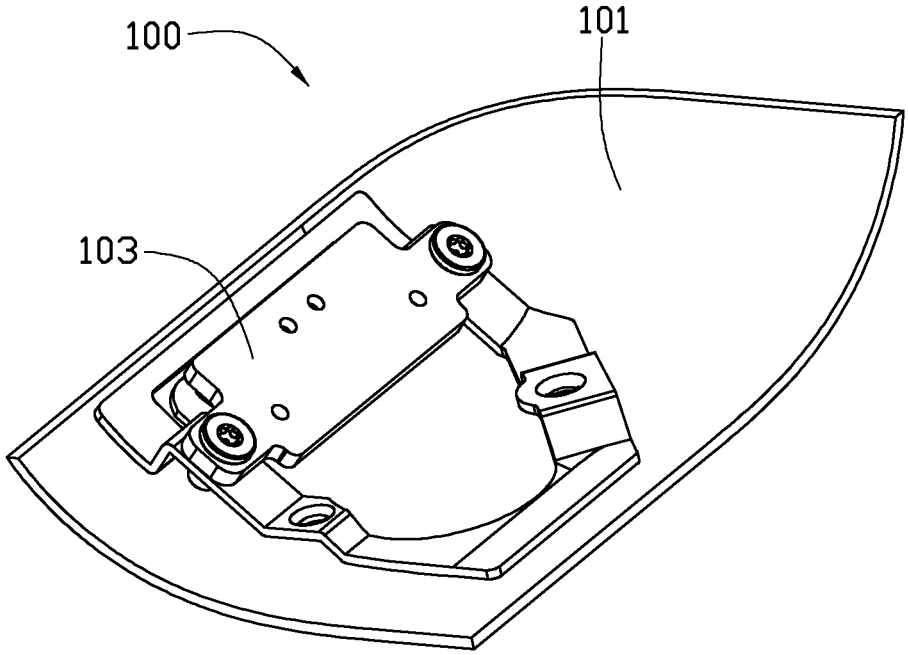
FIG. 1 is a partial, assembled, isometric view of one embodiment of an electronic device, in which the electronic device includes a housing and a keypad assembly mounting on the housing.
Figure 2:
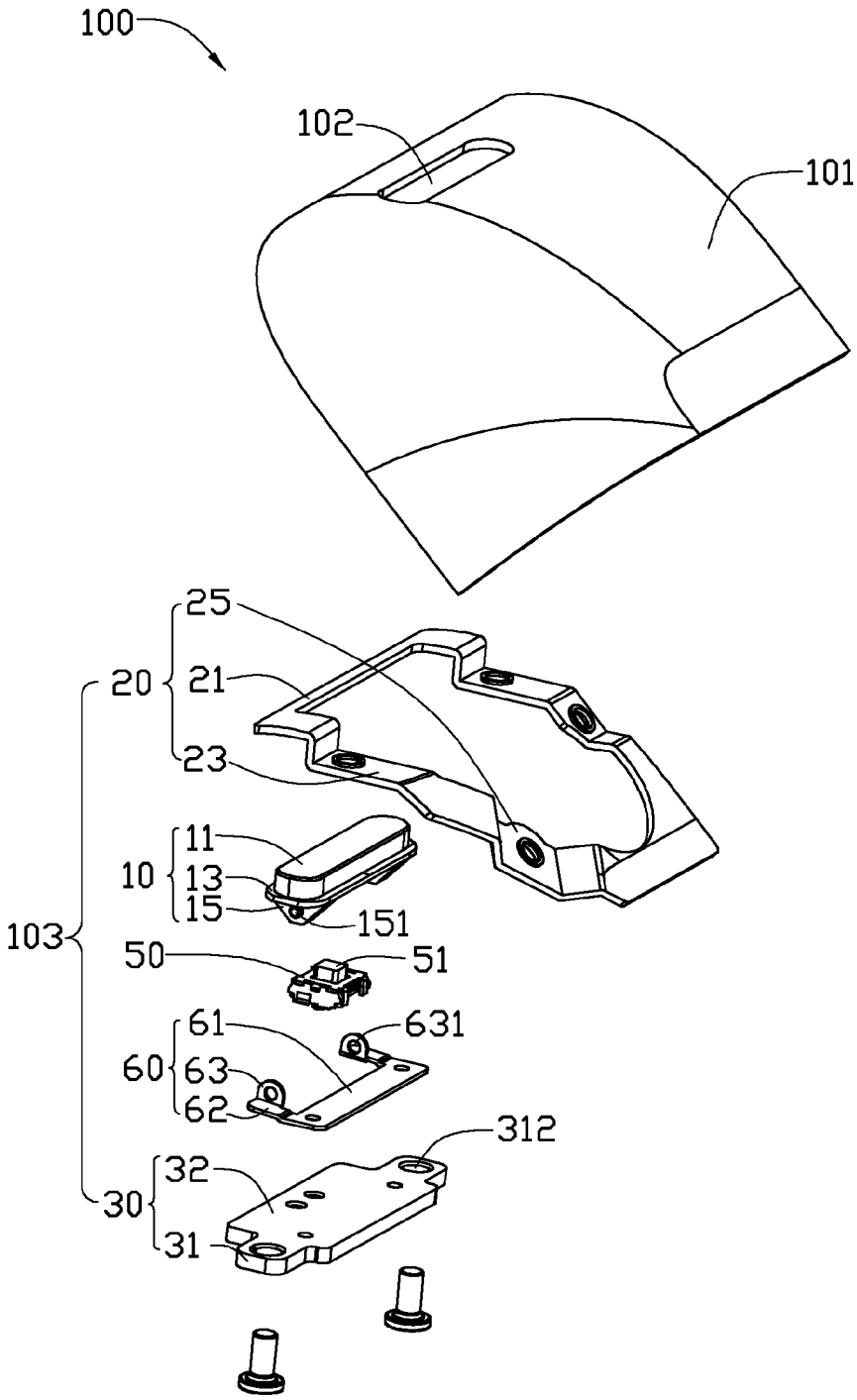
FIG. 2 is an exploded, isometric view of the electronic device shown in FIG. 1.

Referring to FIGS. 1 and 2, an embodiment of an electronic device 100 includes a housing 101 and a keypad assembly 103 located on the housing 101. In the illustrated embodiment, the keypad assembly 103 is a menu button and the housing 101 is an outer case of the electronic device 100. The housing 101 defines a mounting port 102 in the housing 101. In the illustrated embodiment, the mounting port 102 is a through hole.

The keypad assembly 103 includes a keycap 10, a fixing bracket 20, a support member 30, a key switch 50, and a resilient member 60. The keycap 10 is partially received in the mounting port 102. The fixing bracket 20 is fixed on an inner surface of the housing 101 adjacent to the mounting port 102. The support member 30 is fixed to the fixing bracket 20 and located opposite to the mounting port 102. The key switch 50 is fixed on the support member 30. The resilient member 60 interconnects the keycap 10 and the support member 30.

The keycap 10 includes a contact portion 11, a limiting portion 13 and two connecting portions 15. The contact portion 11 is substantially oblong, and slidably received in the mounting port 102. The limiting portion 13 is arranged at a side of the contact portion 11. The limiting portion 13 is larger than the mounting port 102, such that contact portion 11 is retained within the mounting port 102. The two connecting portions 15 are located at opposite ends of an outer surface of the limiting portion 13. In the illustrated embodiment, each connecting portion 15 includes a pivot post 151 arranged at the center of the corresponding connecting portion 15.

The fixing bracket 20 includes a first fixing portion 21, two second fixing portions 23, and a third fixing portion 25. The first fixing portion 21 is substantially rectangular, and fixed in an inner side of the housing 101. The two second fixing portions 23 extend from opposite ends of the first fixing portion 21, and are fixed to opposite ends of the third fixing portion 25. The first fixing portion 21, the second fixing portions 23 and the third fixing portion 25 cooperatively form a substantially closed bracket. In this embodiment, the first fixing portion 21 is fixed on an inner side of the housing 101 by welding. The third fixing portion 25 is used to fix other components (not shown) of the electronic device 100.

The support member 30 includes a main body 31 and a support portion 32 located at the center of one side of the main body 31. The main body 31 defines two through holes 312 in opposite ends of the main body 31. The main body 31 is fixed on the second fixing portion 23 of the fixing bracket 20 via a plurality of threaded fasteners (not shown) received in the through holes 312.

The key switch 50 is fixed on the support portion 32 of the support member 30, and includes a triggering portion 51. The limiting portion 13 of the keycap 10 contacts the triggering portion 51 to trigger the key switch 50. In this embodiment, the key switch 50 is fixed on the support member 30 by welding.

The resilient member 60 includes a first resilient portion 61, two second resilient portions 62, and two connecting portions 63. The first resilient portion 61 is fixed on a side of the support member 30 adjoining the key switch 50. The two second resilient portions 62 extend from opposite ends of the first resilient portion 61. The two connecting portions 63 are located on a side of the second resilient portions 62, respectively. Each connecting portion 63 defines a pivotal hole 631 in a middle portion of the corresponding connecting portion 63. The pivot posts 151 of the keycap 10 are received in the pivotal holes 631, such that the resilient member 60 is rotatably connected to the keycap 10. In the illustrated embodiment, the resilient member 60 is integrally made from an elastic material.

Figure 3:
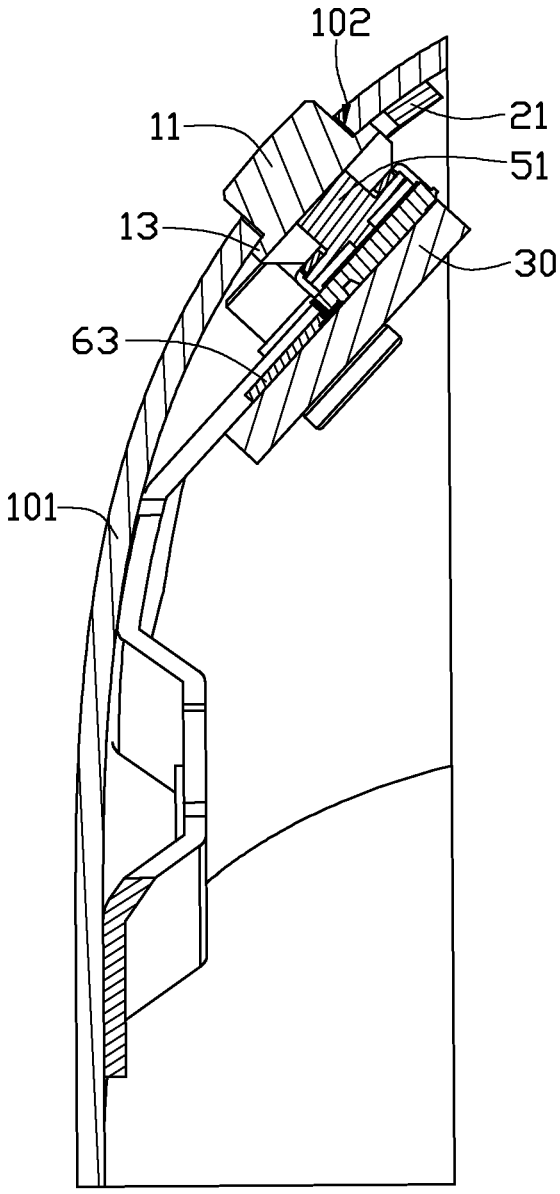
FIG. 3 is a partial cutaway isometric view of the electronic device shown in FIG. 1.

Referring to FIGS. 2 and 3, during assembly of the keypad assembly 103, the first fixing portion 21 of the fixing bracket 20 is fixed on an inner side of the housing 101. The opposite ends of the main body 31 of the support member 30 are connected to the two second fixing portions 23 of the fixing bracket 20. The contact portion 11 of the keycap 10 is received in the mounting port 102 of the housing 101. The key switch 50 is fixed on a side of the support member 30. The pivot posts 151 of the keycap 10 are received in the pivotal holes 631 of the resilient member 60, such that the resilient member 60 is rotatably connected to the keycap 10. The first fixing portion 61 of the resilient member 60 is fixed on the support member 30.

When the keycap 10 is depressed, the keycap 10 slides toward the triggering portion 51 of the key switch 50 until the key switch 50 is triggered. When the keycap 10 is released, the triggering portion 51 of the key switch 50 returns to a relaxed state and resists the keycap 10, such that the second resilient portions 62 of the resilient member 60 are elastically deformed. Thus, the limiting portion 13 of the keycap 10 tightly contacts the triggering portion 51 of the key switch 50, so that the keypad assembly 103 provides an acceptable resistance.

It should be pointed out that the elasticity of the resilient member 60 is less than the biasing force provided by the keycap 10, whereby the key switch 50 is prevented from being triggered inadvertently.

It is to be understood that the fixing bracket 20 can also be omitted, correspondingly, whereby the support member 30 is fixed on an inner side of the housing 101.

Finally, while the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure as defined by the appended claims.

What is claimed is:

1. A keypad assembly comprising:

a support member;

a key switch fixed on the support member and comprising a triggering portion;

a keycap located opposite to the triggering portion and comprising a limiting portion; and a resilient member interconnecting the limiting portion of the keycap and the support member, wherein the resilient member comprises a first resilient portion, two second resilient portions extending from opposite ends of the first resilient portion perpendicular to the first resilient portion and two connecting portions located on a side of the two second resilient portions, respectively, the two connecting portions are connected to the keycap, the resilient member is elastically deformed, and the limiting portion is resisted against the triggering portion when the key switch is not triggered.

2. The keypad assembly of claim 1, wherein the keycap further comprises two pivot posts arranged at opposite sides of the limiting portion of the keycap, and each connecting portion defines a pivotal hole in a middle portion of the corresponding connecting portion to receive the pivot posts, respectively.

3. The keypad assembly of claim 1, further comprising a fixing bracket fixed to the support member.

4. The keypad assembly of claim 3, wherein the support member comprises a main body and a support portion located at the center of a side of the main body, and the key switch is fixed on the support portion.

5. The keypad assembly of claim 4, wherein the fixing bracket comprises a first fixing portion, two second fixing portions extending from opposite ends of the first fixing portion and a third fixing portion connected to the two second fixing portions, and opposite ends of the main body are fixed on the two second fixing portions.

6. The keypad assembly of claim 1, wherein the keycap further comprises a contact portion, the limiting portion is arranged at a side of the contact portion.

7. A keypad assembly comprising:

a support member;

a key switch fixed on the support member and comprising a triggering portion;

a keycap located opposite to the triggering portion and comprising a limiting portion; and a resilient member interconnecting the limiting portion of the keycap and the support member, wherein the resilient member comprises a first resilient portion, two second resilient portions extending from opposite ends of the first resilient portion perpendicular to the first resilient portion and two connecting portions located on a side of the two second resilient portions, respectively, the two connecting portions are connected to the keycap, the resilient member is capable of elastically deforming, the limiting portion is resisted against the triggering portion when the key switch is not triggered, and the resilient member is resumed to be deformed when the keycap biases the triggering portion.

8. The keypad assembly of claim 7, wherein the keycap further comprises two pivot posts arranged at opposite sides of the limiting portion of the keycap, and each connecting portion defines a pivotal hole in a middle portion of the corresponding connecting portion to receive the pivot posts, respectively.

9. The keypad assembly of claim 7, further comprising a fixing bracket fixed to the support member.

10. The keypad assembly of claim 9, wherein the support member comprises a main body and a support portion located at the center of a side of the main body, and the key switch is fixed on the support portion.

11. The keypad assembly of claim 10, wherein the fixing bracket comprises a first fixing portion, two second fixing portions extending from opposite ends of the first fixing portion and a third fixing portion connected to the two second fixing portions, and opposite ends of the main body are fixed on the two second fixing portions.

12. The keypad assembly of claim 7, wherein the keycap further comprises a contact portion, the limiting portion is arranged at a side of the contact portion.

13. An electronic device comprising:

a housing defining a mounting port;

a keypad assembly located on the housing, the keypad assembly comprising:

a support member fixed to the housing;

a key switch fixed on the support member and comprising a triggering portion;

a keycap located opposite to the triggering portion and partially received in the mounting port, the key cap comprising a limiting portion; and a resilient member interconnecting the limiting portion of the keycap and the support member, wherein the resilient member comprises a first resilient portion, two second resilient portions extending from opposite ends of the first resilient portion perpendicular to the first resilient portion and two connecting portions located on a side of the two second resilient portions, respectively, the two connecting portions are connected to the keycap, the resilient member is elastically deformed, and the limiting portion is resisted against the triggering portion when the key switch is not triggered.

14. The electronic device of claim 13, wherein the keycap further comprises two pivot posts arranged at opposite sides of the limiting portion of the keycap, and each connecting portion defines a pivotal hole in a middle portion of the corresponding connecting portion to receive the pivot posts, respectively.

15. The electronic device of claim 13, further comprising a fixing bracket fixed to the support member.

16. The electronic device of claim 15, wherein the support member comprises a main body and a support portion located at the center of a side of the main body, and the key switch is fixed on the support portion.

17. The electronic device of claim 16, wherein the fixing bracket comprises a first fixing portion, two second fixing portions extending from opposite ends of the first fixing portion and a third fixing portion connected to the two second fixing portions, and opposite ends of the main body are fixed on the two second fixing portions.

* * * * *